US009412510B2

(12) United States Patent
Chu et al.

(10) Patent No.: US 9,412,510 B2
(45) Date of Patent: Aug. 9, 2016

(54) THREE-PHASE REACTOR

(71) Applicant: Delta Electronics (Shanghai) CO., LTD, Shanghai (CN)

(72) Inventors: Jiang Chu, Shanghai (CN); Zhi Huang, Shanghai (CN); Juming Hu, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 0 days.

(21) Appl. No.: 14/527,325

(22) Filed: Oct. 29, 2014

(65) Prior Publication Data

US 2015/0170828 A1 Jun. 18, 2015

(30) Foreign Application Priority Data

Dec. 12, 2013 (CN) ..... 2013 1 0681076

(51) Int. Cl.

| | |
|---|---|
| ***H01F 17/06*** | (2006.01) |
| ***H01F 27/24*** | (2006.01) |
| ***H01F 27/28*** | (2006.01) |
| ***H01F 27/34*** | (2006.01) |
| ***H01F 30/12*** | (2006.01) |
| ***H01F 3/14*** | (2006.01) |
| *H01F 3/10* | (2006.01) |

(52) U.S. Cl.

CPC ..... *H01F 27/346* (2013.01); *H01F 3/14* (2013.01); *H01F 30/12* (2013.01); *H01F 2003/106* (2013.01)

(58) Field of Classification Search

CPC ... H01F 27/346; H01F 27/255; H01F 27/245; H01F 3/14; H01F 3/08; H01F 3/02; H01F 3/10; H01F 30/12; H01F 2003/106

USPC ..... 336/5, 212, 178, 233, 214, 234

See application file for complete search history.

(56) References Cited

U.S. PATENT DOCUMENTS

| | | | | |
|---|---|---|---|---|
| 2,909,742 | A * | 10/1959 | Lamberton | H01F 27/25 336/210 |
| 3,671,903 | A * | 6/1972 | Arrington | H01F 27/263 336/192 |
| 6,980,077 | B1 * | 12/2005 | Chandrasekaran | H01F 27/255 336/212 |
| 2013/0286703 | A1 * | 10/2013 | Inaba | H01F 1/26 363/131 |

FOREIGN PATENT DOCUMENTS

| | | | |
|---|---|---|---|
| CN | 101430961 | A | 5/2009 |
| CN | 202025630 | U | 11/2011 |
| CN | 202487347 | U | 10/2012 |
| CN | 102956344 | A | 3/2013 |

OTHER PUBLICATIONS

Office Action issued Mar. 10, 2016 by the TW Office.
Office Action issued on May 10, 2016 by the CN Office.

* cited by examiner

*Primary Examiner* — Mangtin Lian
(74) *Attorney, Agent, or Firm* — Yunling Ren; Eaton & Van Winkle

(57) ABSTRACT

The present application discloses a three-phase reactor, including: an upper yoke and a lower yoke, the upper yoke and the lower yoke containing a first material; and at least three first core columns, the first core columns containing a second material, and the both ends of each of the first core columns being connected with the upper yoke and the lower yoke, respectively, wherein, the relative permeability of the first material is greater than that of the second material, and at least one air gap is positioned in each of the first core columns. In the three-phase reactor proposed by the present disclosure, the yokes are made of a material different from that of the core columns, and air gaps are positioned in the core columns, so that the eddy current losses may be reduced significantly and the requirement for the use of high power may be satisfied.

6 Claims, 5 Drawing Sheets

THREE-PHASE REACTOR

CROSS-REFERENCE TO RELATED APPLICATIONS

This application claims priority under 35 U.S.C. §119 to Chinese Patent Application No. 201310681076.0, filed on Dec. 12, 2013, the entire contents of which are incorporated herein by reference.

TECHNICAL FIELD

The present disclosure relates to a three-phase reactor.

BACKGROUND

The loss of the traditional reactor made of silicon steel sheet increases sharply due to the switching frequency up to thousands of Hertz in the current application fields of high-power frequency converter, UPS (Uninterruptible Power Supply) and new energy, which causes that the traditional reactor made of silicon steel sheet cannot adapt to the high-frequency application fields. Thus, the alloy powder block core, Amorphous and Nanocrystalline are usually used in the reactor of high power and high-frequency, and the JFE Corporation of Japan uses the super silicon steel with the silicon content 6.5% deposited by chemical vapor infiltration in recent years, which is a good choice.

The magnetic core (iron core) made of non-crystalline material usually can be made by laminating strips, and the super silicon steel is also made by stacking sheet materials. As same as copper foils and aluminum foils, the magnetic core and the super silicon steel both are continuous flat conductor or curved conductor, which causes a huge eddy current loss once there is an alternating magnetic flux in the same or similar direction with the normal direction of the flat surface or the curved surface of the conductor.

In accordance with the relationship among magnetic flux, resistance and magnetic motive force in magnetic circuit, the distributions of the magnetic motive force in a magnetic circuit are in direct proportion to the resistance of this magnetic circuit. Generally, the calculation formula of the magnetic motive force is as follows:

$$NI=\Phi\cdot R_1+\ .\ .\ .\ +\Phi\cdot R_n=\Phi\cdot l_{e1}/(\mu_{e1}\cdot A_{e1})+\ .\ .\ .\ +\Phi\cdot l_{en}/(\mu_{en}\cdot A_{en})$$

Where, NI indicates the magnetic motive force; Φ indicates the magnetic flux; R indicates the resistance; l indicates the length of the magnetic circuit; μ indicates the relative permeability of the magnetic core; A indicates the sectional area of the magnetic core.

The common magnetic cores are all tangible solids. Being affected by visual factors, designers often only consider the solid magnetic core itself and the air gap connected in series with the solid magnetic core, but ignore that the whole intangible space is actually a magnetic path when they design a magnetic circuit. These intangible magnetic circuits are connected in series or in parallel with the solid magnetic cores, and have a great influence on the performance of the whole magnetic circuits. As the relative permeability of the space is very low (only "1" in value), in the space slightly farther away from the excitation source (e.g., windings), the magnetic field intensity with frequency less than the RF frequency would decay rapidly to a very low value that could be ignored. In the space near the excitation source, losses would be generated as long as the magnetic fields which are called Near Field Radiations meet a conductor.

Currently, in the alloy powder core reactor applied in the case where switching frequency is more than thousands of Hertz, usually, a normative square closed magnetic circuit is formed by stacking a plurality of the alloy powder block cores, as illustrated in FIG. 1. The stacked alloy powder block core 1 shown in FIG. 1 includes horizontal magnetic cores 1-1 and vertical magnetic cores 1-2. The reference sign 2 denotes windings (e.g., windings made of copper foils or aluminum foils) wound around the vertical magnetic cores 1-2 (i.e., core columns), while there is no windings wound around the horizontal magnetic cores 1-1 (i.e., yokes). Similar to an annular alloy powder core, the stacked alloy powder block core has a magnetic circuit with uniform resistance, and the difference between them is that the windings of the reactor made of the annular alloy powder core can be distributed uniformly along the perimeter of the core column. Thus, the magnetic motive force generated by the windings of the reactor made of the annular alloy powder core is distributed uniformly along the magnetic circuit of the core column, and the magnetic motive force can be consumed exactly by the uniform resistance of the core column, so the magnetic motive force would not be concentrated on part of the magnetic circuit. But for the alloy powder core formed by stacking, just like the stacked alloy powder block core 1 shown in FIG. 1, the windings only can be wound around two parallel columns, and no windings are wound around the other two columns (e.g., the horizontal magnetic core 1-1 shown in FIG. 1), which causes that the magnetic motive force generated by such windings cannot be distributed uniformly along the magnetic circuit and a serious near field radiation will be generated by the diffusion of magnetic flux due to local magnetic motive force concentration.

In FIG. 1, the magnetic motive force between the two terminals of the upper yoke and the lower yoke is NI·b/(2a+2b), where a is the horizontal side length of the rectangular magnetic circuit shown by the dotted line in FIG. 1, and b is the vertical side length of the rectangular magnetic circuit. Losses are generated when the radiated magnetic fluxes (e.g., the magnetic field lines shown by reference signs 3, 4, 5, 6 in FIG. 1) meet a conductor, and the losses are particularly serious when the direction of the magnetic flux is consistent with or close to the normal direction of the flat surface or the curved surface of the conductor. As the direction of magnetic field lines 4 and 5 in FIG. 1 is close to or consistent with the normal direction of the windings 2, serious eddy current losses will be generated on the windings 2 due to these near field magnetic fluxes.

Besides, the three-phase reactor is usually used in the current application fields of high-power frequency converter, UPS and new energy. The material of the yokes of an integrated three-phase reactor (for example, three-phase three-column reactor or three-phase five-column reactor) must have a very high relative permeability, otherwise, the electric inductances of the three phases will be in imbalance. The powder core material usually has a relative permeability which is not high, so the integrated three-phase reactor cannot be made of only the alloy powder core. And for the same electrical properties, the total volume of three single-phase reactors is larger than that of one three-phase reactor, thus, three single-phase reactors cannot be used as a substitution for one three-phase reactor in the situation where there is a requirement for the size of the reactor.

When the reactor for three-phase electricity is made of a material with high permeability, such as silicon steel sheet, amorphous nano-crystalline material, the three-phase three-column reactor (or three-phase five-column reactor) can be made because of the symmetry of three-phase electricity. The yoke of such reactor is an entirety without any air gap, and any additional loss will not be generated inside the yoke under such magnetic flux distribution. However, the air gap in the core column is necessary for avoiding the magnetic saturation of the core column. Because the relative permeability of silicon steel sheet is considerably larger than that of the air, the magnetic fluxes at the interface between an iron core and the air flow vertically in and out of the iron core.

For example, FIG. 2 illustrates a reactor, in which the core columns are made of a material with high relative permeability, the core columns are made by stacking laminated magnetic cores, and there are air gaps in the core column. The magnetic fluxes 10 and 20 shown in FIG. 2 are positioned in the magnetic cores. The magnetic core plane of which the magnetic fluxes 20 flow in and out is composed by stacking multiple laminated magnetic cores insulated from each other and high eddy current will not be generated within the plane; but the magnetic core plane of which the magnetic fluxes 10 flow in and out is an entirety and serious additional eddy current losses are generated due to the huge eddy current (as shown by reference signs 30 and 40 in FIG. 2) induced within the plane, and the diffused magnetic fluxes will have a great influence on the losses of nearby conductors (e.g., windings, components, etc.).

To overcome the above drawbacks, two core column materials with different relative permeability need to be combined, so as to maybe eliminate the magnetic flux which is consistent with the normal direction of the planar conductor, so that the eddy current losses may be reduced significantly.

SUMMARY OF THE INVENTION

In one embodiment of the present disclosure, a three-phase reactor is provided, which may include: an upper yoke and a lower yoke, the upper yoke and the lower yoke containing a first material; and at least three first core columns, the first core columns containing a second material and ends of the first core columns being connected with the upper yoke and the lower yoke respectively, wherein, the relative permeability of the first material is greater than that of the second material, and at least one air gap is positioned in each of the first core columns.

In another embodiment of the present disclosure, a three-phase five-column reactor is provided, which may include: an upper yoke and a lower yoke, the upper yoke and the lower yoke containing a first material; and three first core columns and two second core columns, the ends of the first core columns and ends of the second core columns being connected with the upper yoke and the lower yoke, wherein the first core columns contain a second material, the relative permeability of the first material is greater than that of the second material, and at least one air gap is positioned in each of the first core columns; the second core columns contain a third material, and the relative permeability of the third material is greater than that of the second material.

Compared with conventional technologies, in the three-phase reactor proposed by the present disclosure, the yokes are made of a material different from that of the core columns, and air gaps are positioned in the core columns, so that the eddy current losses may be reduced significantly and the requirement for the use of high power may be satisfied.

DETAILED DESCRIPTION

Figure 1:
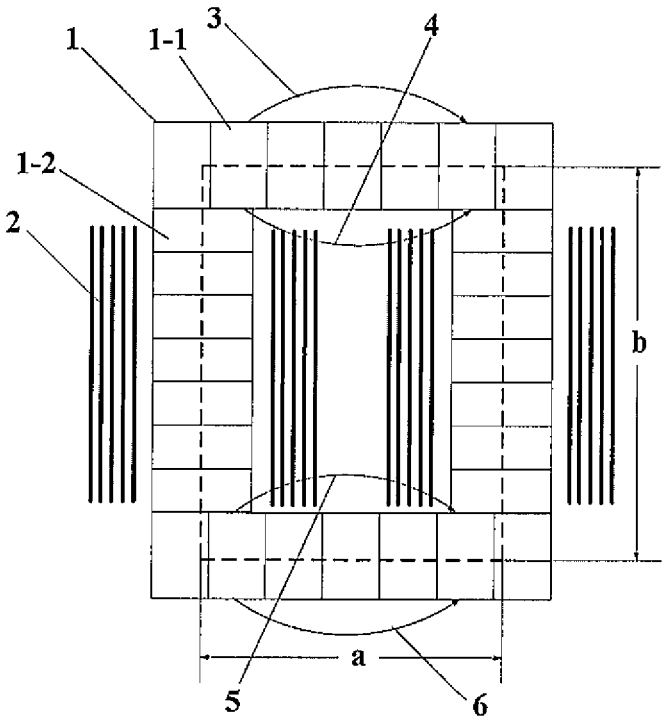
Fig. 1 (Prior Art)
FIG. 1 illustratively shows the structure of a reactor in conventional technologies.

Detailed description of the present disclosure will be made with reference to drawings and embodiments. It shall be appreciated that the embodiments described herein are for the purposes of illustration but not to limit the present disclosure. In addition, it shall be noted that only the parts related to the present disclosure but not all the structures are shown in the drawings for the convenience of description.

First Embodiment

Figure 3:
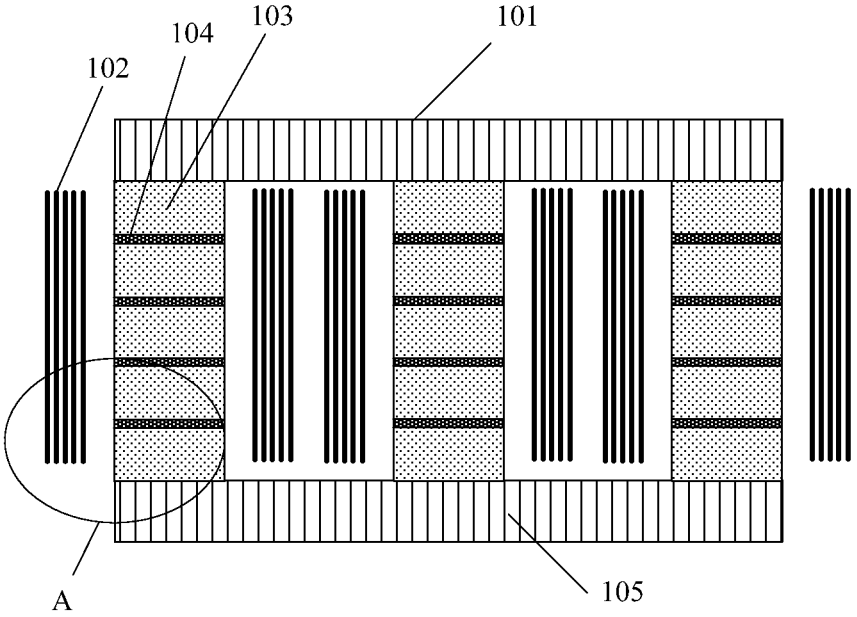
FIG. 3 illustratively shows a schematic side view of a reactor structure according to a first embodiment of the present disclosure.

The present embodiment provides a three-phase reactor, the schematic side view of which is shown in FIG. 3. The reactor has a three-phase three-column structure, and includes an upper yoke 101, a lower yoke 105, windings 102, three core columns 103 and air gaps 104 in the core columns.

Among them, the upper yoke 101 and the lower yoke 105 are made of high permeability material whose relative permeability is greater than 2000, and usually are made by stacking flat sheet materials. For example, the upper yoke 101 and the lower yoke 105 are made of Fe-based amorphous stacked sheet, Fe-based nanocrystalline stacked sheet, permalloy stacked sheet or stacked silicon steel sheet.

The core columns 103 are made of alloy powder block core with high saturation magnetic flux density, and the alloy powder block core is made of material whose relative permeability is lower. For example, the relative permeability of the core columns 103 is in the range from tens to one hundred or two hundreds. In general, the core columns 103 are made of alloy powder core such as Fe-based amorphous powder core, Co-based amorphous powder core, Fe-based nanocrystalline powder core or Co-based nanocrystalline powder core, or the core columns 103 are made of alloy powder core such as Fe—Si powder core, Fe—Si—Al powder core or Fe—Ni powder core. In an exemplary embodiment, the relative permeability of the material of the upper yoke 101 and lower yoke 105 is larger than 10 times of the relative permeability of the core columns 103. In another exemplary embodiment, the relative permeability of the material of the upper yoke 101 and lower yoke 105 is larger than 20 times of the relative permeability of the core columns 103. When the relative permeability of the material of the core columns 103 and the relative permeability of the material of the upper yoke 101 and lower yoke 105 follow the above relationship, the electric inductances of each phases in the three-phase reactor which is made up of these core columns and yokes are about the same.

The windings 102 are wound around the core columns 103, and the windings 102 may be copper foils, aluminum foils, copper wires or aluminum wires. Air gaps 104 are positioned in each of the core columns 103, and the air gaps 104 are filled with materials such as epoxy resins or insulating paper. FIG. 3 shows that the air gaps 104 are distributed uniformly in each of the core columns 103. In practice, the air gaps 104 may be distributed uniformly or be distributed non-uniformly in each of the core columns 103, and the number of the air gaps may also be adjusted as required, but there must be at least one air gap 104 in each of the core columns 103. In addition, no air gap is positioned at the interface between the core columns 103 and the upper yoke 101 or the interface between the core columns 103 and the lower yoke 105.

In the reactor structure shown in FIG. 3, throughout the iron core magnetic circuit, because the resistance of the high permeability material is very small, only a small part of magnetic motive force produced by the windings is distributed in the upper yoke 101 and lower yoke 105 made of high permeability material, while most of magnetic motive force is distributed in the core columns 103 made of low permeability material and the air gaps 104. Thus, for the reactor with this structure, its overall copper loss and the corresponding loss in the clamp may be reduced significantly.

In the case that the core columns 103 are made of the alloy powder block core, as the permeability specifications of the alloy powder block core are limited, the initial permeability of the whole core columns wound by the windings may be regulated by adjusting the number and size of the air gaps, so that it is more convenient to design.

Figure 5:
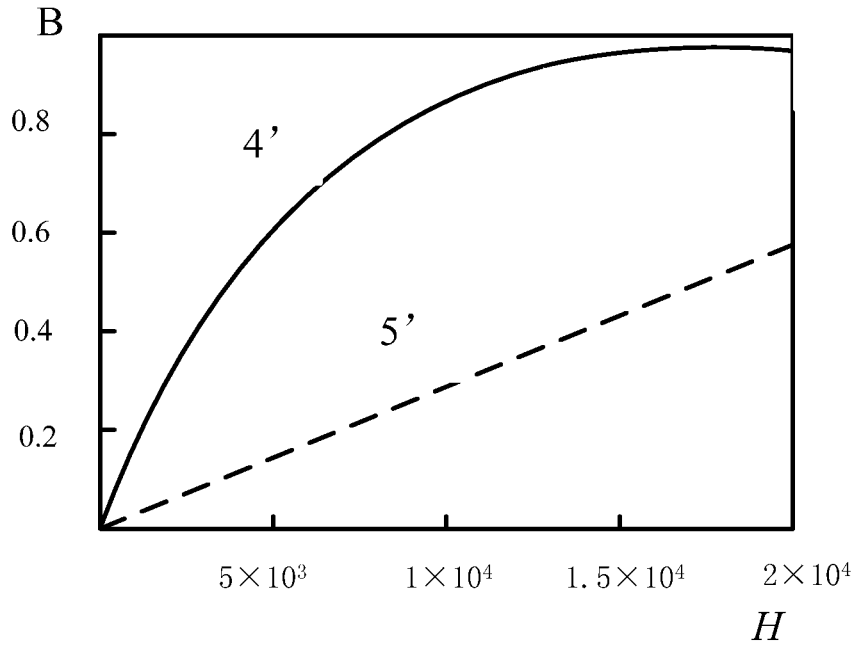
FIG. 5 is a graph showing the BH relationships of two kinds of magnetic core materials.

The relationship of the permeability μ, magnetic flux density B and magnetic field intensity H of a magnetic material follows: $B=\mu H$. If there is no air gap in the core column made of alloy powder core, when certain magnetic field intensity is applied on the core column, the permeability of the alloy powder core is decreased as the magnetic field intensity increases. The curve 5' in FIG. 5 is the graph illustrating the case that the magnetic flux density B changes with the magnetic field strength H according to the typical alloy powder core Sendust $\mu_{26}$ (Sendust $\mu_{26}$ is Fe—Si—Al whose initial permeability is 26) without air gap. As shown in FIG. 5, the permeability μ (B/H) of the alloy powder core Sendust $\mu_{26}$ is reduced sharply as the magnetic field intensity H increases. The inductance of the reactor made of this type of material is also reduced sharply as the magnetic field intensity H increases.

Figure 6:
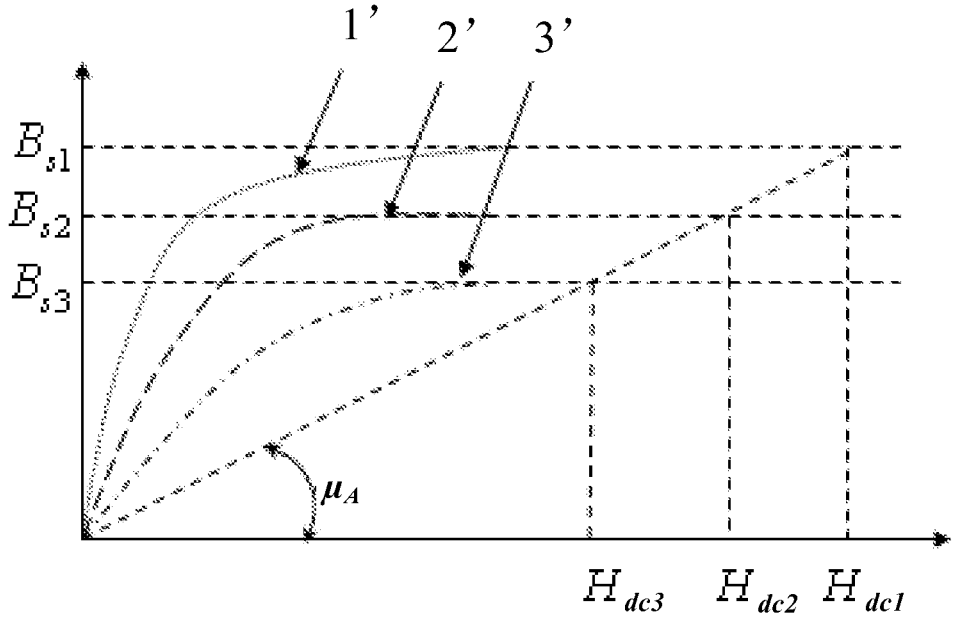
FIG. 6 illustratively shows the magnetizing curves of three kinds of magnetic core materials.

It can be known from the relationship of the permeability μ, magnetic flux density B and magnetic field intensity H of the magnetic material that, in the case of the same permeability (as described above, by positioning air gaps, the materials with different initial permeability may be adjusted to have initial permeability equal to one another), the greater the saturation magnetic flux density Bs is, the greater magnetic field intensity H can be withstood by the magnetic material, that is, the better the current bias characteristic is. FIG. 6 illustrates the magnetizing curves of three kinds of magnetic cores with different saturation magnetic flux densities. As shown in FIG. 6, curves 1', 2', 3' illustrate the magnetizing curves of three different magnetic cores respectively, and the relationship between their saturation magnetic flux densities is: $B_{s1}>B_{s2}>B_{s3}$. Air gaps are positioned in the three kinds of materials to adjust their permeability, so as to make the effective permeability of each of the three kinds of materials equal to one another, and equal to $\mu_A$. As shown in FIG. 6, the relationship of the magnetic field intensity that can be withstood by the three kinds of materials is: Hdc1>Hdc2>Hdc3. Thus, it can be concluded that the permeability of the materials with different saturation magnetic flux densities can be adjusted by positioning air gaps therein, and in the case of the same initial permeability, the higher saturation magnetic flux density material may withstand greater magnetic field intensity, that is, the current bias characteristic is better.

Taking the typical alloy powder core Sendust materials as an example, FIG. 5 shows the BH curves of Sendust $\mu_{26}$ and Sendust $\mu_{125}$ (Fe—Si—Al with the initial permeability of 125), wherein the curve 4' is the BH curve of Sendust $\mu_{125}$ and the curve 5' is the BH curve of Sendust $\mu_{26}$. As shown in FIG. 5, the saturation magnetic flux density of Sendust $\mu_{125}$ is larger than that of Sendust $\mu_{26}$.

Figure 7:
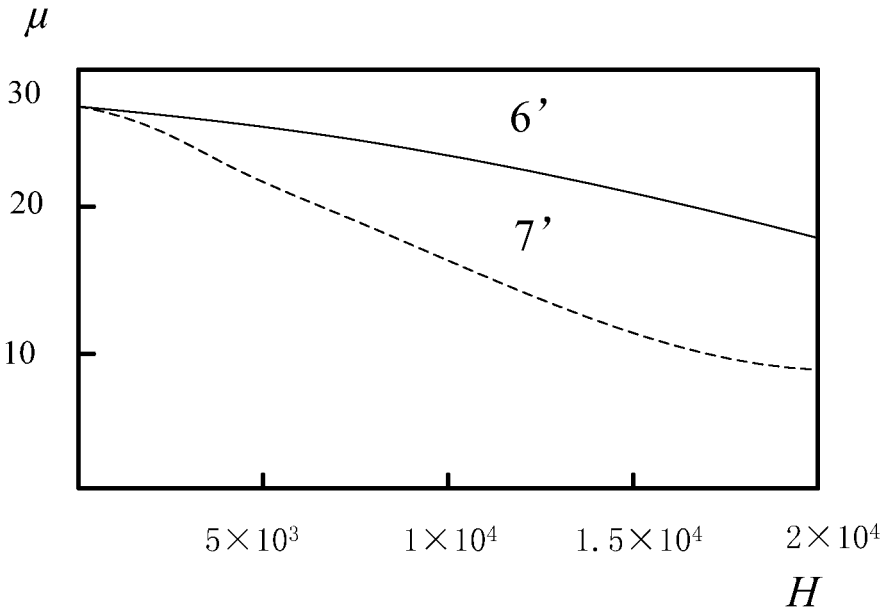
FIG. 7 is a graph showing the μH relationships of two kinds of magnetic core materials.

When the initial permeability of Sendust $\mu_{125}$ is made to be equal to that of Sendust $\mu_{26}$ (for example, both equal to 26) by positioning air gaps in Sendust $\mu_{125}$, the μH curves of Sendust $\mu_{125}$ and Sendust $\mu_{26}$ are shown in FIG. 7. In FIG. 7, the curve 6' is the μH curve of Sendust $\mu_{125}$ whose initial permeability is adjusted to 26 by positioning air gaps in it, and the curve 7' is the μH curve of Sendust $\mu_{26}$ whose initial permeability of Sendust $\mu_{26}$ is also 26. As shown in FIG. 7, the magnetic field intensity H that can be withstood in the curve 6' is larger than that in curve 7', that is, the current bias characteristic of the material shown by the curve 6' is better than that of the material shown by the curve 7'. That is to say, better current bias characteristic may be obtained by positioning air gaps in alloy powder core material having higher saturation magnetic flux density. Therefore, the material which has higher saturation magnetic flux density should be selected for the core columns when positioning air gaps in the core columns. Thus, the core columns 103 shown in FIG. 3 are exactly made of the alloy powder core material with high saturation magnetic flux density, where high saturation magnetic flux density in one embodiment means that the saturation magnetic flux density of the material is greater than or equal to 1.2 T, which may also be applied in the following embodiments, but the present invention is not limited to this.

Figure 2:
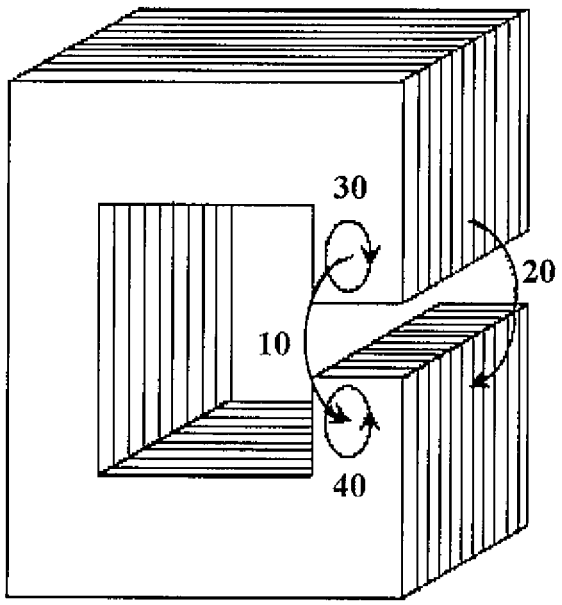
Fig. 2 (Prior Art)
FIG. 2 illustratively shows the structure of another reactor in conventional technologies.

Meanwhile, as the alloy powder core may be made by pressing the alloy powder particles and insulating particles, continuous planar conductor will not be formed in any direction, thus, after air gaps are positioned in the alloy powder core, the eddy current like what is shown in FIG. 2 may not be generated because the magnetic field lines flow vertically in and out of the alloy powder core. There is no air gap at the interface between the alloy powder core and the lamination materials with high permeability, and there is almost no diffusion magnetic flux flowing vertically in and out of the lamination materials, so the eddy current like what is shown in FIG. 2 may not be generated in the lamination materials.

Figure 4:
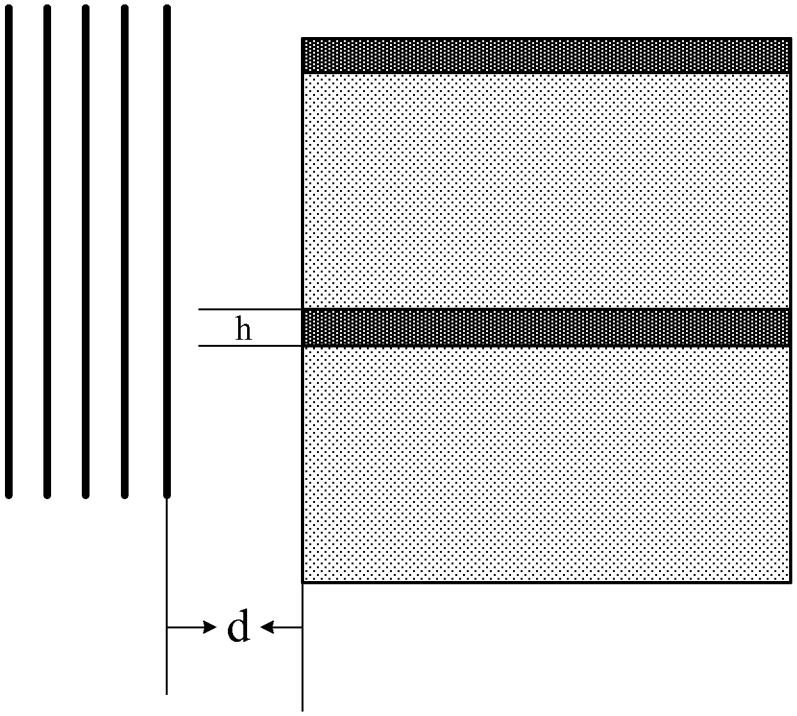
FIG. 4 illustratively shows the partial enlargement view of part A shown in FIG. 3.

FIG. 4 illustratively shows the partial enlargement view of part A shown in FIG. 3. As shown in FIG. 4, the air gap 104 has a thickness h, and the minimum distance from the winding 102 to the core column (that is, to the air gap) is d. The thicknesses of all the air gaps may be the same, but the invention is not limited to this. To avoid the loss due to the wire in the winding being cut by the magnetic line at the air gap 104, the minimum distance d from the winding to the air gap may be 3-5 times of the thickness h of the air gap. In an exemplary embodiment, the thickness h of the air gap is about 1 mm, and the minimum distance d from the winding to the air gap is about 5 mm. It should be noted that the distance d is not limited from the above description.

In the three-phase reactor structure provided by the present embodiment, the upper yoke and the lower yoke are made of material with high permeability, the core columns are made of alloy powder core material with low permeability, and air gaps are positioned in the core columns; the relationship between the thickness of the air gap and the minimum distance from the winding to the air gap may be adjusted, so as to reduce the eddy current loss significantly. Moreover, the initial permeability of the core column wound by the windings can be regulated by adjusting the number and size of the air gaps, so that it is convenient for designing, and the reactor with good current bias characteristic may be obtained easily.

Second Embodiment

Figure 8:
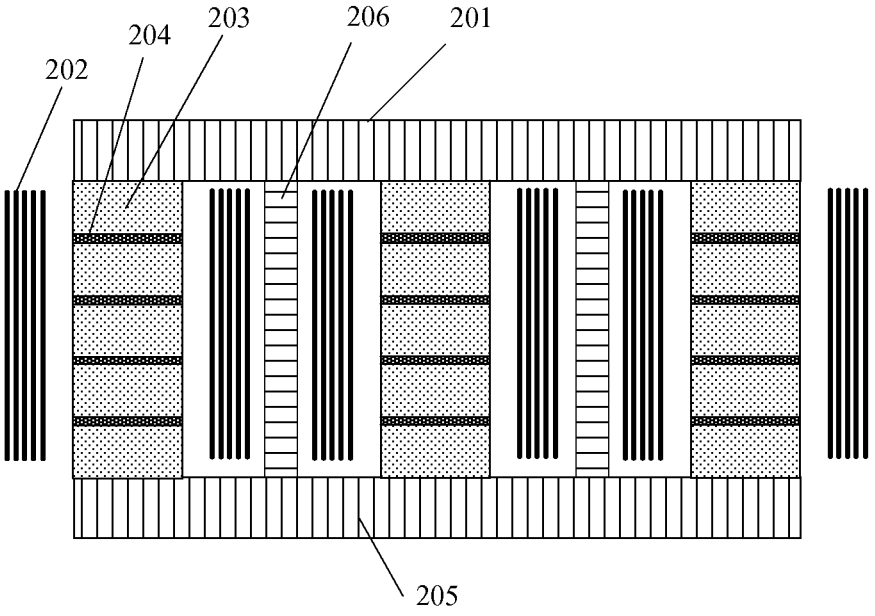
FIG. 8 illustratively shows a schematic side view of a reactor structure according to a second embodiment of the present disclosure.

The present embodiment provides another three-phase reactor, a schematic structural side view of which is shown in FIG. 8. The reactor has a three-phase five-column structure, and includes an upper yoke 201, a lower yoke 205, windings 202, three first core columns 203 and air gaps 204 in the first core columns. The difference between this embodiment and the first embodiment is that the reactor provided by this embodiment further includes two second core columns 206, both of the two second core columns 206 are connected with the upper yoke 201 and the lower yoke 205, and the three first core columns 203 and the two second core columns 206 are alternately positioned. In this embodiment, the second core columns 206 are made of high relative permeability material whose relative permeability is greater than 2000. For example, the material of the second core columns 206 may be the same as that of the upper yoke 201 and the lower yoke 205. Besides, the compositions of materials for other parts of the reactor, the thickness of the air gap, and the principle of setting the distance from the winding to the core columns in the present embodiment are identical with those in the first embodiment.

For example, the upper yoke 201 and the lower yoke 205 are made of high permeability material whose relative permeability is greater than 2000, and usually are made by stacking flat sheet materials. For example, the upper yoke 201 and the lower yoke 205 are made of Fe-based amorphous stacked sheet, Fe-based nanocrystalline stacked sheet, permalloy stacked sheet or stacked silicon steel sheet. The invention is not limited to this.

The first core columns 203 are made of the alloy powder block core with high saturation magnetic flux density, and the alloy powder block core is made of material whose relative permeability is lower. For example, the relative permeability of the first core columns 203 is in the range from tens to one hundred or two hundreds. In general, the first core columns 203 are made of alloy powder core such as Fe-based amorphous powder core, Co-based amorphous powder core, Fe-based nanocrystalline powder core or Co-based nanocrystalline powder core, or the first core columns 203 are made of alloy powder core such as Fe—Si powder core, Fe—Si—Al powder core, or Fe—Ni powder core. In an exemplary embodiment, the relative permeability of the material of the upper yoke 201 and lower yoke 205 is larger than 10 times of the relative permeability of the first core columns 203. In another exemplary embodiment, the relative permeability of the material of the upper yoke 201 and lower yoke 205 is larger than 20 times of the relative permeability of the first core columns 203. When the relative permeability of the material of the first core columns 203 and the relative permeability of the material of the upper yoke 201 and lower yoke 205 follow this relationship, the inductances of each phases in the three-phase reactor which is made up of those core columns and yokes are about the same.

The windings 202 are wound around the first core columns 203, and the windings 202 may be copper foils, aluminum foils, copper wires or aluminum wires. Air gaps 204 are positioned in each of the first core columns 203, and the air gaps 204 are filled with materials such as epoxy resins or insulating paper. FIG. 8 shows that the air gaps 204 are distributed uniformly in each of the first core columns 203. In practice, the air gaps 204 may be distributed uniformly or be distributed non-uniformly in each of the first core columns 203, and the number of the air gaps may also be adjusted as required, but there must be at least one air gap 204 in each of the first core columns 203. In addition, no air gap is positioned at the interface between the first core columns 203 and the upper yoke 201 or the interface between the first core columns 203 and the lower yoke 205. Moreover, no air gap is positioned in the second core columns 206. To avoid the loss due to the wires in the windings being cut by the magnetic line at the air gap 204, the minimum distance d from the windings to the air gap may be about 3-5 times of the thickness h of the air gap, just the same as in the first embodiment.

In the five core columns of the reactor structure provided by this embodiment, the three first core columns 203 are made of the alloy powder block core with high saturation magnetic flux density and low relative permeability, and the relative permeability of the two second core columns 206 is greater than that of the three first core columns 203. For example, the two second core columns 206 may be made of high permeability material which is the same as that of the upper yoke and lower yoke. As compared with the case that five core columns are all made of the alloy powder block core with high saturation magnetic flux density and low relative permeability, the size of the reactor may be decreased so that the size requirements of related components may be satisfied, and the eddy current loss may be reduced significantly.

Third Embodiment

Figure 9:
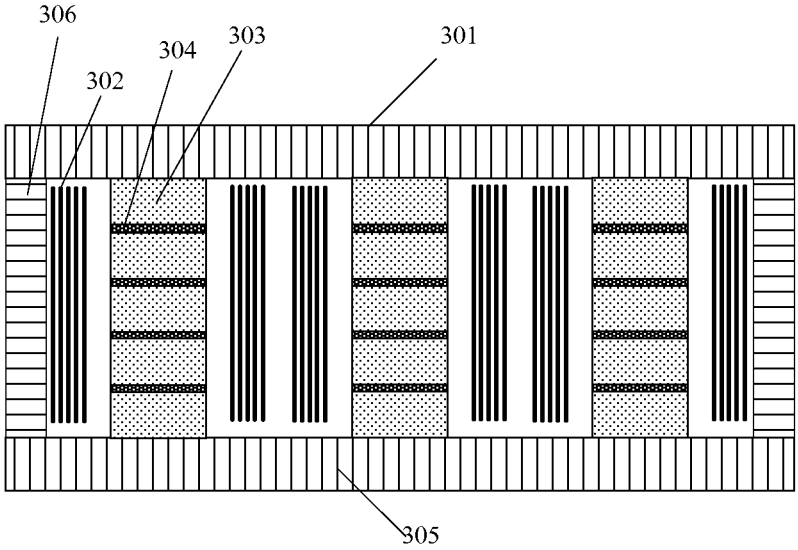
FIG. 9 illustratively shows a schematic side view of a reactor structure according to a third embodiment of the present disclosure.

The present embodiment provides further another three-phase reactor, a schematic structural side view of which is shown in FIG. 9. The reactor has a three-phase five-column structure, and includes an upper yoke 301, a lower yoke 305, windings 302, three first core columns 303, air gaps 304 in the first core columns 303, and two second core columns 306. The difference between this embodiment and the second embodiment is that, in the reactor provided by this embodiment, the three first core columns 303 are positioned between the two second core columns 306 as shown in FIG. 9. In this embodiment, the second core columns 306 are made of high relative permeability material whose relative permeability is greater than 2000. For example, the material of the second core columns 306 may be the same as that of the upper yoke 301 and the lower yoke 305. In the reactor structure provided by this embodiment, the material compositions of other parts, the thickness of the air gap, and the principle of setting the distance from the windings to the core columns are identical with those in the second embodiment, except that the position for positioning the second core columns 306 is different from that in the second embodiment.

For the three-phase five-column reactor provided by this embodiment, the eddy current loss may be reduced significantly, and the size of the reactor may be decreased so that the size requirements of related components may be satisfied.

In the process of manufacturing the three-phase five-column reactor according to the second embodiment, when the first core columns 203 and the second core columns 206 are hold tightly by clamps, the theoretical height of the clamped first core columns 203 is required to be equal to that of the clamped second core columns 206. Because the first core columns 203 and the second core columns 206 are made of different materials, and the stretching rates of the materials are different from each other, high processing precision is required for making the height of the first core columns 203 match with that of the second core columns 206 strictly.

In the three-phase five-column reactor structure provided by this embodiment, the clamp force required by the first core columns 303 is in the vertical direction, while the clamp force required by the second core columns 306 is in the horizontal direction, so that requirements for the processing precision and the size matching are less than those for the reactor in the second embodiment shown in FIG. 8, hence the manufacturing process is simple.

It shall be noted that the above descriptions only illustrate exemplary embodiments and technology principles of the present disclosure. One of ordinary skill in this art will appreciate that the present disclosure is not limited to the particular embodiments described herein, and one of ordinary skill in this art may make various changes, re-adjustments and substitutions without departing from the protection scope of the present disclosure. Thus, although the present disclosure is described in detail with reference to the above embodiments, the present disclosure is not limited to those embodiments, and other equivalent embodiments may be included without departing from the idea of the present disclosure. The scope of the present disclosure is defined by the scope of the appended claims.

LIST OF REFERENCE SIGNS

1 stacked alloy powder block core
1-1 horizontal magnetic core
1-2 vertical magnetic core
3, 4, 5, 6, magnetic field lines
a horizontal side lengths of the rectangular magnetic circuit
b vertical side lengths of the rectangular magnetic circuit
10, 20 magnetic flux in the Fe core column made of high relative permeability material
30, 40 eddy current
101, 201, 301 upper yoke
102, 202, 302 windings
103, 203, 303 core column
104, 204, 304 air gap
105, 205, 305 lower yoke
206, 306 the second magnetic core
1' magnetizing curve of magnetic core material with saturation magnetic flux density Bs1
2' magnetizing curve of magnetic core material with saturation magnetic flux density Bs2
3' magnetizing curve of magnetic core material with saturation magnetic flux density Bs3
4' BH curve of Sendust $\mu L_{125}$
5' BH curve of Sendust $\mu_{26}$
6' μH curve of Sendust $\mu_{125}$ whose initial permeability is made to 26 by positioning air gap therein
7' μH curve of Sendust $\mu_{26}$

What is claimed is:

1. A three-phase reactor, comprising:

an upper yoke and a lower yoke, the upper yoke and the lower yoke containing a first material; and at least three first core columns, the first core columns containing a second material, and both ends of each of the first core columns being connected with the upper yoke and the lower yoke, respectively, wherein the relative permeability of the first material is greater than that of the second material, and at least one air gap is positioned in each of the first core columns; and no air gap is positioned at interfaces between the first core columns and the upper yoke or interfaces between the first core columns and the lower yoke; and windings wound around the first core columns, wherein a minimum distance from the windings to the first core column is 3-5 times of a thickness of the air gap.

2. The three-phase reactor according to claim 1, wherein the relative permeability of the first material is larger than 10 times of the relative permeability of the second material.

3. The three-phase reactor according to claim 1, wherein the first material is one material selected from the group of Fe-based amorphous, Fe-based nanocrystalline, permalloy and silicon steel sheet.

4. The three-phase reactor according to claim 1, wherein the initial relative permeability of the second material is greater than or equal to 40.

5. The three-phase reactor according to claim 1, wherein the second material is an alloy powder core, which is one selected from the group of a Fe-based amorphous powder core, a Co-based amorphous powder core, a Fe-based nanocrystalline powder core, a Co-based nanocrystalline powder core, a Fe—Si powder core, a Fe—Si—Al powder core and a Fe—Ni powder core.

6. The three-phase reactor according to claim 1, wherein the windings are copper foils, aluminum foils, copper wires or aluminum wires.

* * * * *